US010815722B2

(12) United States Patent
Jones

(10) Patent No.: US 10,815,722 B2
(45) Date of Patent: Oct. 27, 2020

(54) WINDOW SHUTTER SYSTEM

(71) Applicant: Blanche B. Jones, Henrico, VA (US)

(72) Inventor: Blanche B. Jones, Henrico, VA (US)

( * ) Notice: Subject to any disclaimer, the term of this patent is extended or adjusted under 35 U.S.C. 154(b) by 160 days.

(21) Appl. No.: 15/852,802

(22) Filed: Dec. 22, 2017

(65) Prior Publication Data

US 2018/0258688 A1 Sep. 13, 2018

Related U.S. Application Data

(60) Provisional application No. 62/468,967, filed on Mar. 9, 2017.

(51) Int. Cl.
*E06B 9/04* (2006.01)
*E05D 15/06* (2006.01)

(52) U.S. Cl.
CPC ..... *E06B 9/04* (2013.01); *E05D 15/0621* (2013.01); *E05Y 2900/146* (2013.01)

(58) Field of Classification Search
CPC ..... E05D 15/0621; E05D 15/0652; E05D 15/0656; E05D 15/0682; E06B 9/04
See application file for complete search history.

(56) References Cited

U.S. PATENT DOCUMENTS 32,512 A * 6/1861 Douglass
2,611,936 A * 9/1952 Wheeler ..... E04F 10/10 160/54
4,242,836 A * 1/1981 Anderson ..... E06B 9/04 49/370
5,103,593 A * 4/1992 McNaughton ..... E04G 21/30 49/460
6,021,608 A * 2/2000 Ollison ..... E05B 65/08 292/67
6,820,381 B1 11/2004 Ballough
7,584,579 B1 * 9/2009 Everitt ..... E06B 9/04 160/101
8,302,652 B2 11/2012 Hirsh et al.
2005/0055929 A1 * 3/2005 Rude ..... E06B 7/08 52/473
2006/0230695 A1 10/2006 Swergold
2007/0084138 A1 * 4/2007 Cassista ..... E06B 9/04 52/202
2008/0196310 A1 8/2008 Wang
2014/0059931 A1 3/2014 Tasheiko et al.

* cited by examiner

*Primary Examiner* — Gregory J Strimbu
(74) *Attorney, Agent, or Firm* — Foley & Lardner LLP

(57) ABSTRACT

A window shutter system includes a frame assembly and a shutter. The frame assembly is configured to be coupled to a wall. The frame assembly includes a first rail and a second rail. The first rail includes a first mating feature. The second rail is parallel to the first rail. The shutter is configured to be selectively coupled to, and selectively repositionable along, the first rail and the second rail. The shutter includes a second mating feature, a first side, and a second side. The second mating feature is configured to selectively interface with the first mating feature to maintain a position of the shutter relative to the first rail. The first side is configured to be selectively exposed. The second side is configured to be selectively exposed. The second side is different from the first side.

14 Claims, 8 Drawing Sheets

WINDOW SHUTTER SYSTEM

CROSS-REFERENCE TO RELATED APPLICATION

This Application claims priority to U.S. Provisional Patent Application Ser. No. 62/468,967 filed on Mar. 9, 2017, the complete disclosure of which is incorporated by reference herein in its entirety.

TECHNICAL FIELD

The present disclosure relates to shutters for windows. More specifically, the present disclosure relates to a window shutter system, including a frame assembly and at least one shutter that is removably coupled to the frame assembly.

BACKGROUND

Many buildings include windows. In some applications, these buildings include at least one shutter (e.g., cover, louver, etc.) positioned proximate a window. The shutter may be fixedly attached to the building, such as through the use of fasteners or adhesives, or may be hingedly attached to the building, such as through the use of hinges attached to the shutter and fixedly attached to the building. These shutters are not intended to be routinely removed from the building.

Over time, shutters may accumulate debris (e.g., dirt, dust, mud, mold, etc.). For example, dirt may be washed from siding adjacent a shutter and flow onto the shutter where the dirt may solidify and accumulate. As a result of this debris accumulation, shutters may no longer operate as intended and/or may not maintain a desirable aesthetic state (e.g., color, shape, style, etc.).

Additionally, shutters may structurally and/or aesthetically degrade over time. For example, shutters may become warped, faded, or rotten. As a result of this degradation, a shutter may structurally fail (e.g., become unintentionally removed from a building, etc.) and/or may not maintain a desirable aesthetic state.

Accordingly, it is desirable to develop a system for coupling a shutter to a building such that the shutter can be selectively fixed to a building and easily removed from the building. In this way, the system could facilitate rapid and simple cleaning, servicing, and/or replacement of the shutter, such as when the shutter becomes dirty or degraded or when a user desires to replace an aesthetic appearance of one shutter with an aesthetic appearance of another shutter.

SUMMARY

One embodiment relates to a window shutter system that includes a frame assembly and a first shutter. The frame assembly is configured to be coupled to a wall. The frame assembly includes a first rail and a second rail. The first rail includes a first mating feature. The second rail is parallel to the first rail. The first shutter is configured to be selectively coupled to, and selectively repositionable along, the first rail and the second rail. The first shutter includes a second mating feature, a first side, and a second side. The second mating feature is configured to selectively interface with the first mating feature to maintain a position of the first shutter relative to the first rail. The first side is configured to be selectively exposed. The second side is configured to be selectively exposed. The second side is different from the first side.

Another embodiment relates to a window shutter system that includes a frame assembly and a first shutter. The frame assembly is configured to be coupled to a wall. The frame assembly includes a first rail and a second rail. The second rail is parallel to the first rail. The first shutter is configured to be selectively coupled to, and selectively repositionable along, the first rail and the second rail. The first shutter includes a first side and a second side. The first side is configured to be selectively exposed and has a first target aesthetic appearance. The second side is configured to be selectively exposed and has a second target aesthetic appearance. The second target aesthetic appearance is different from the first target aesthetic appearance. The first shutter is reversible such that either the first side of the first shutter or the second side of the first shutter is exposed when the first shutter is coupled to the first rail and the second rail.

Yet another embodiment relates to a window shutter system that includes a frame assembly, a first shutter, and a second shutter. The frame assembly is configured to be coupled to a wall. The first shutter is configured to be selectively coupled to, and selectively repositionable along, the frame assembly. The first shutter includes a first side and a second side. The first side is configured to be selectively exposed. The first side has a first target aesthetic appearance. The second side is configured to be selectively exposed and has a second target aesthetic appearance. The second target aesthetic appearance is different from the first target aesthetic appearance. The second shutter is configured to be selectively coupled to, and selectively repositionable along, the frame assembly independent of the first shutter. The third side is configured to be selectively exposed and has a third target aesthetic appearance. The fourth side is configured to be selectively exposed and has a fourth target aesthetic appearance. The fourth target aesthetic appearance is different from the third target aesthetic appearance. The first shutter and the second shutter are reversible.

DETAILED DESCRIPTION

Figure 1:
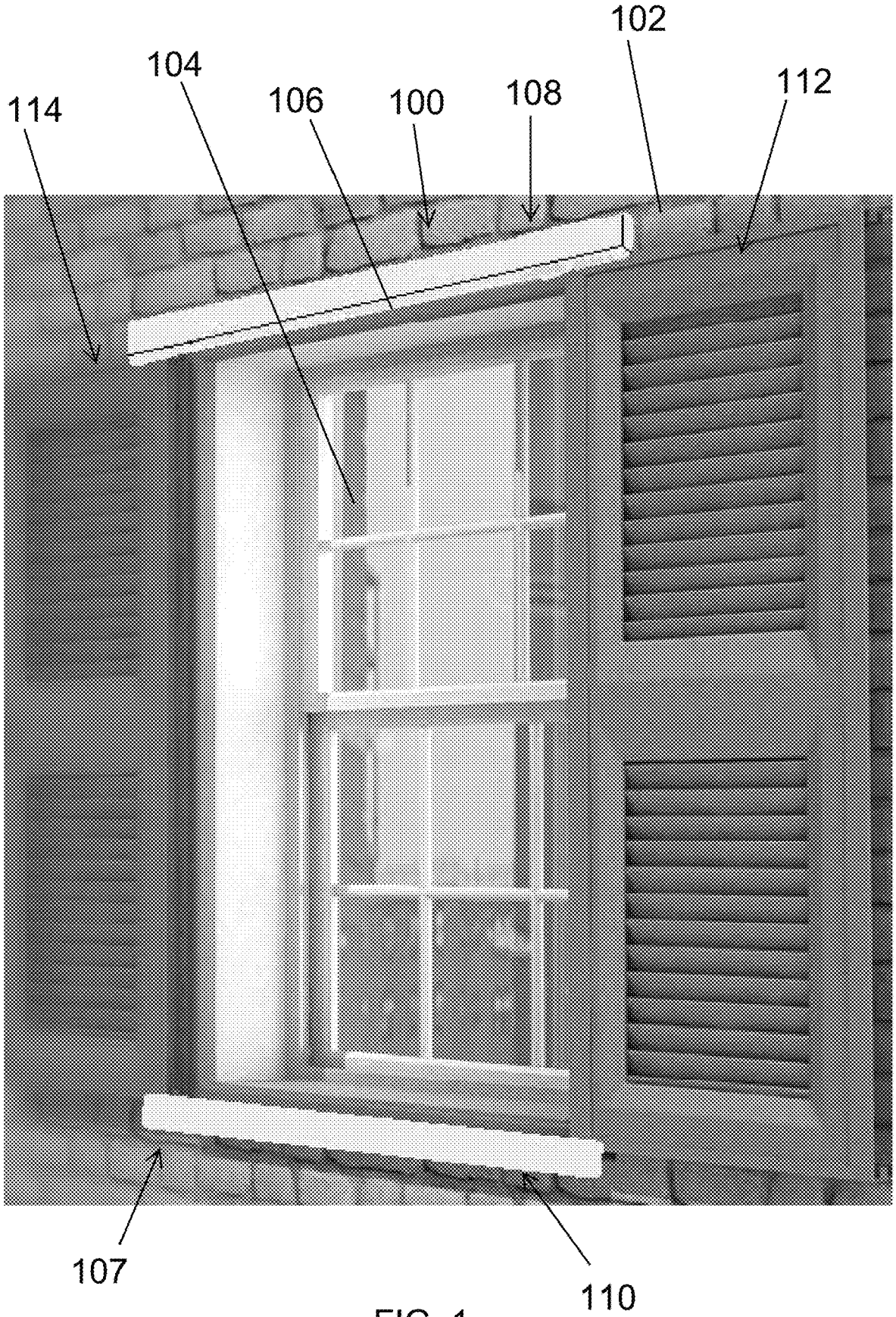
FIG. 1 is a front perspective view of a window shutter system and coupled to a building, according to an exemplary embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to a window shutter system that includes a frame assembly and two shutters selectively coupled to, and selectively repositionable along, the frame assembly. The window shutter system is configured such that each of the shutters may be decoupled from the frame assembly such that the shutter may be reversed and then coupled to the frame assembly. By reversing one or both of the shutters, the window shutter system facilitates rapid visual and aesthetic changes to a building. For example, the shutters may be reversed seasonally (e.g., to maintain an in-season appearance, etc.). Additionally, reversing a shutter may allow a useful life of the shutter to be increased (e.g., due to distributing wearing on two separate sides of the shutter, etc.). The window shutter system may include mating features to maintain a position of each of the shutters relative to the frame assembly (e.g., such that a window may be selectively covered by the shutters, etc.).

Figure 2:
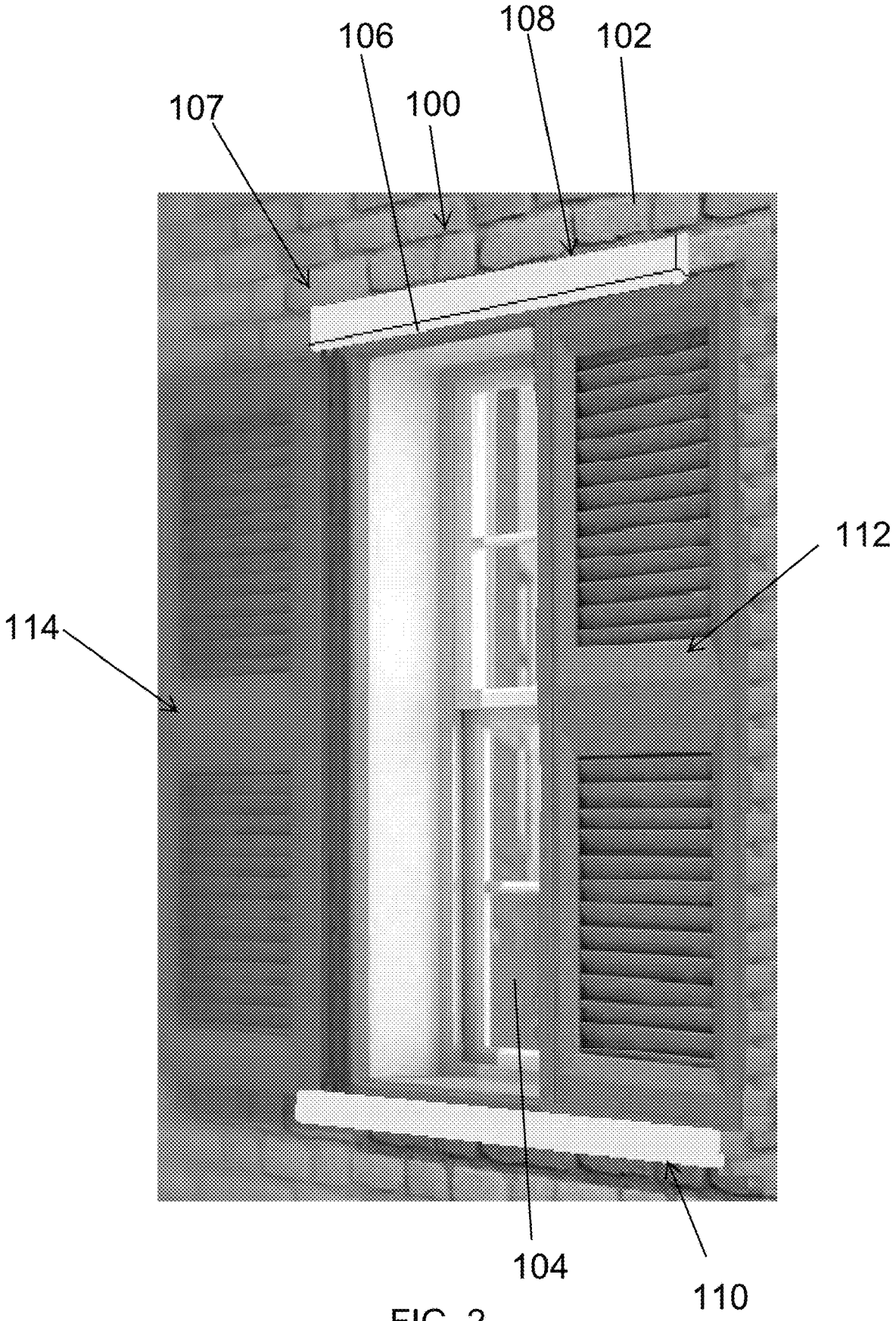
FIG. 2 is another front perspective view of the window shutter system shown in FIG. 1.

Referring now to FIGS. 1-2, a system (e.g., assembly, mechanism, etc.), shown as a window shutter system 100, is shown. The window shutter system 100 is coupled to a wall, shown as a wall 102, of a building. The building may be a residential building (e.g., home, house, apartment, condominium, etc.), a commercial building (e.g., warehouse, office building, etc.), or an industrial building (e.g., manufacturing plant, etc.). In various applications, the wall 102 may be an exterior wall of a building. The wall 102 may be a stone or brick wall and may be covered by siding (e.g., aluminum siding, etc.).

According to an exemplary embodiment, the wall 102 includes a window (e.g., glass window, single hung window, double hung window, awning window, bay window, bow window, casement window, gliding window, picture window, etc.), shown as a window 104. The window shutter system 100 may be positioned over the window 104 and may be configured to selectively cover and expose the window 104. In various embodiments, the window 104 is positioned within a sill (e.g., aperture, indentation, etc.), shown as a sill 106, in the wall 102. The sill 106 may allow the window 104 to be positioned within the wall 102 inwards relative to the window shutter system 100. In some alternative embodiments, the window shutter system 100 is not positioned over the window 104 and is instead configured to selectively cover and expose the wall 102.

The window shutter system 100 includes an assembly, shown as a frame assembly 107. The frame assembly 107 is coupled to the wall 102. For example, the frame assembly 107 may be fastened to the wall 102 through the use of fasteners (e.g., nails, screws, etc.). In other examples, the frame assembly 107 is adhered (e.g., glued, caulked, etc.) to the wall 102. The frame assembly 107 includes a first member (e.g., track, channel, structure, etc.), shown as a first rail 108, and a second member (e.g., track, channel, structure, etc.), shown as a second rail 110. Additionally, when the frame assembly 107 is coupled to the wall 102, the first rail 108 is disposed along a first axis parallel to a second axis along which the second rail 110 is disposed.

The window shutter system 100 also includes a first shutter (e.g., cover, panel, louver, etc.), shown as a first shutter 112. The first shutter 112 is selectively repositionable (e.g., linearly translatable, etc.) with respect to the first rail 108 and the second rail 110. For example, the first shutter 112 may slide within the first rail 108 and the second rail 110 simultaneously. In this way, the first shutter 112 may be selectively repositioned within the first rail 108 and the second rail 110 such that the first shutter 112 at least partially covers the window 104, as shown in FIG. 2.

The first shutter 112 is selectively coupled to the first rail 108 and the second rail 110. The first shutter 112 is configured to be selectively repositionable with respect to the first rail 108 and the second rail 110 when the first shutter 112 is coupled to the first rail 108 and the second rail 110. When the first shutter 112 is decoupled from the first rail 108 and the second rail 110, the first shutter 112 may be taken away from the wall 102.

After the first shutter 112 has been decoupled from the frame assembly 107, the first shutter 112 may be reversed or flipped. For example, while a first side (e.g., a front side, etc.) of the first shutter 112 was exposed when the first shutter was coupled to the first rail 108 and the second rail 110, a user may desire to instead hide the first side and expose a second side (e.g., a back side, etc.) of the first shutter 112. The user may then decouple the first shutter 112 from the first rail 108 and the second rail 110, reverse the first shutter 112 so that the first side is now adjacent the wall 102 and the second side is exposed, and couple the first shutter 112 to the first rail 108 and the second rail 110. In this way, a user may easily change the appearance of the first shutter 112 and thus the appearance of the building associated with the first shutter 112. For example, one side of the first shutter 112 may include a plurality of louvers intended to achieve a more conventional appearance while the other side of the first shutter 112 may include graphics, logos, various colors, or insignias that the user may want to display or expose only at certain times (e.g., to correspond with local sporting events, etc.). Alternatively, the first shutter 112 may be decoupled from the first rail 108 and the second rail 110 for cleaning, servicing, painting, or replacing with a new first shutter 112.

The window shutter system 100 also includes a second shutter (e.g., cover, panel, louver, etc.), shown as a second shutter 114. The second shutter 114 is selectively repositionable (e.g., linearly translatable, etc.) with respect to the first rail 108 and the second rail 110. For example, the second shutter 114 may slide within the first rail 108 and the second rail 110 simultaneously. In this way, the second shutter 114 may be selectively repositioned within the first rail 108 and the second rail 110 such that the second shutter 114 at least partially covers the window 104. In various embodiments, the second shutter 114 is configured to be selectively repositioned within the first rail 108 and the second rail 110 independent of the first shutter 112. In other embodiments, the first shutter 112 is coupled to the second shutter 114 such that selective repositioning of the first shutter 112 within the first rail 108 and the second rail 110 causes corresponding repositioning of the second shutter 114 within the first rail 108 and the second rail 110 (e.g., the first shutter 112 and the second shutter 114 may be brought together simultaneously, the first shutter 112 and the second shutter 114 may be brought apart simultaneously, etc.).

The second shutter 114 is selectively coupled to the first rail 108 and the second rail 110. The second shutter 114 is configured to be selectively repositionable with respect to the first rail 108 and the second rail 110 when the second shutter 114 is coupled to the first rail 108 and the second rail 110. When the second shutter 114 is decoupled from the first rail 108 and the second rail 110, the second shutter 114 may be taken away from the wall 102.

After the second shutter 114 has been decoupled from the frame assembly 107, the second shutter 114 may be reversed or flipped. For example, while a first side (e.g., a front side, etc.) of the second shutter 114 is exposed when the first shutter was coupled to the first rail 108 and the second rail 110, a user may desire to instead hide the first side and expose a second side (e.g., a back side, etc.) of the second shutter 114. The user may then decouple the second shutter 114 from the first rail 108 and the second rail 110, reverse the second shutter 114 so that the first side is now adjacent the wall 102 and the second side is exposed, and couple the second shutter 114 to the first rail 108 and the second rail 110. In this way, a user may easily change the appearance of the second shutter 114 and thus the appearance of the building associated with the second shutter 114. For example, one side of the second shutter 114 may include a plurality of louvers intended to achieve a more conventional appearance while the other side of the second shutter 114 may include graphics, logos, various colors, or insignias that the user may want to display or expose only at certain times (e.g., to correspond with local sporting events, etc.). Alternatively, the second shutter 114 may be decoupled from the first rail 108 and the second rail 110 for cleaning, servicing, painting, or replacing with a new second shutter 114. In another example, the first shutter 112 is interchanged (e.g., swapped, replaced, etc.) with the second shutter 114, and the second shutter 114 is interchanged with the first shutter 112.

In various alternative embodiments, each of the first shutter 112 and the second shutter 114 is associated with a first rail 108 and a second rail 110 such that the window shutter system 100 includes a pair of first rails 108 and a pair of second rails 110. The first rails 108 are aligned and the second rails 110 are aligned.

Figure 3:
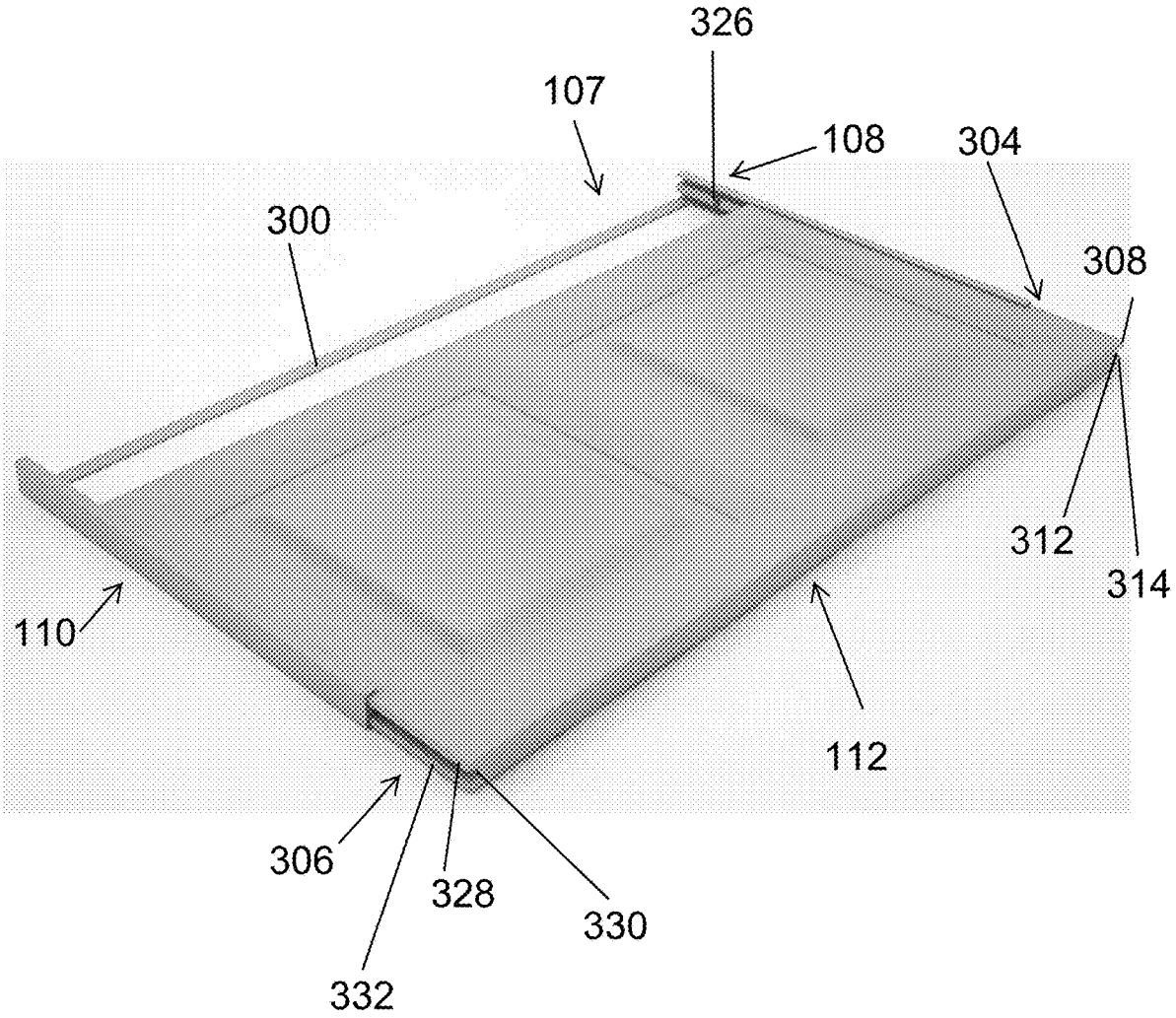
FIG. 3 is a bottom perspective view of a portion of the window shutter system shown in FIG. 1.
Figure 4:
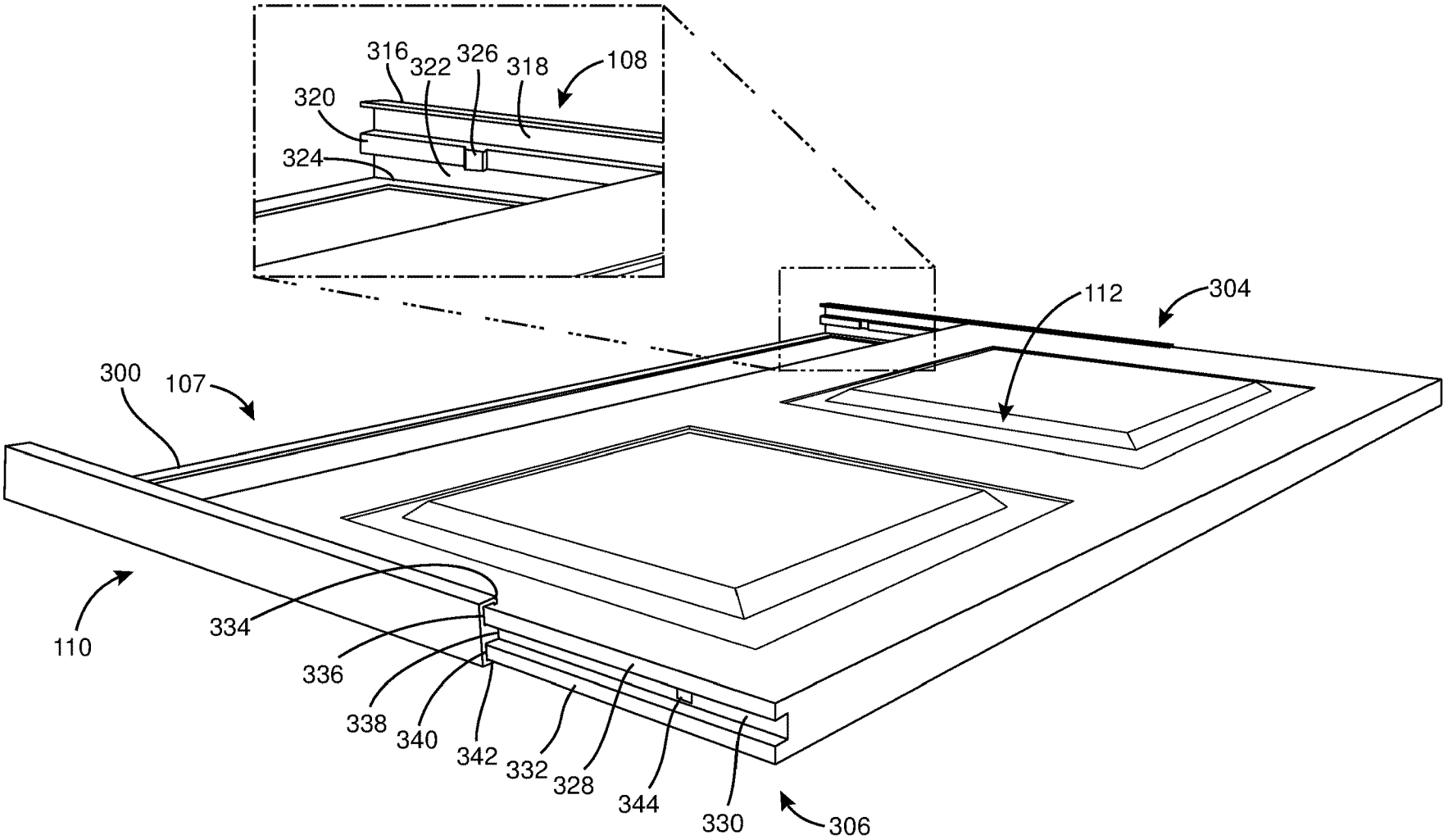
FIG. 4 is a detailed view of the portion of the window shutter system shown in FIG. 3.
Figure 5:
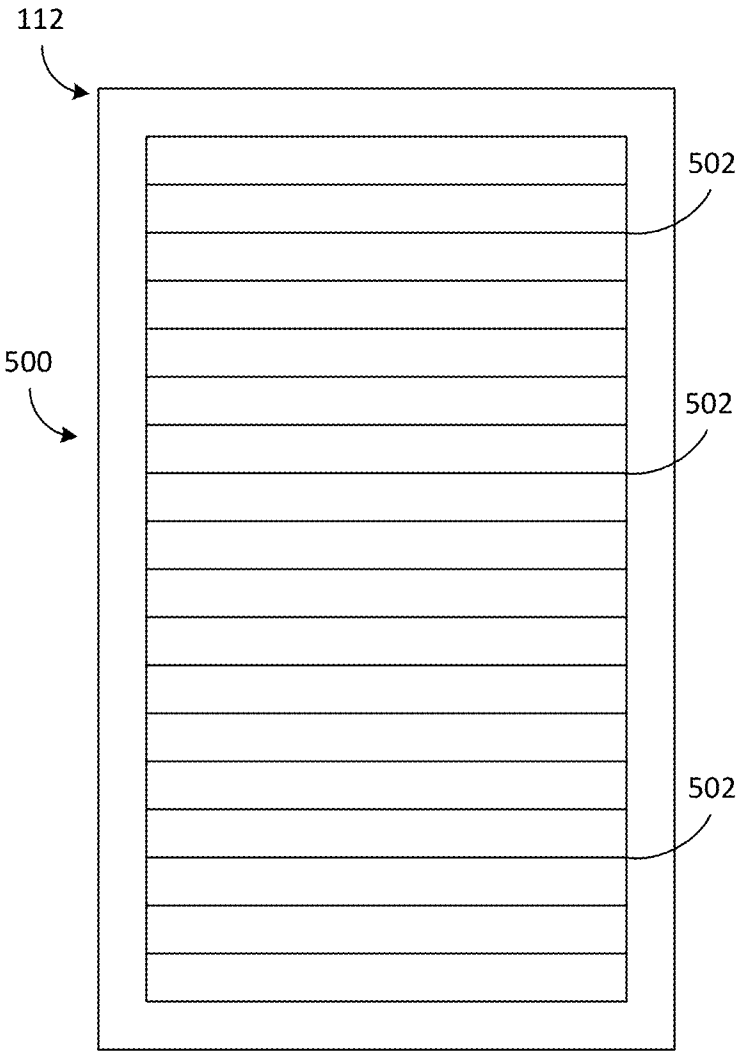
FIG. 5 is a front view of a shutter for the window shutter system shown in FIG. 1.

FIGS. 3-5 illustrate portions of the window shutter system 100 isolated from the wall 102 or the window 104. While only the first shutter 112 is shown in FIGS. 3-5, it is understood that the description of the first shutter 112 similarly applies to the second shutter 114. In various embodiments, the first shutter 112 is structurally identical to the second shutter 114 with regard to interactions with the first rail 108 and the second rail 110. For example, in some applications, the only differences between the first shutter 112 and the second shutter 114 are aesthetic.

The frame assembly 107 includes a first member (e.g., connector, etc.), shown as a first support 300, and a second member, as a second support (not shown). The first support 300 is coupled to the first rail 108 proximate one distal end of the first rail 108 and coupled to the second rail 110 proximate one distal end of the second rail 110, and the second support is coupled to the first rail 108 proximate another distal end of the first rail 108 and coupled to the second rail 110 proximate another distal end of the second rail 110. The first support 300 and the second support function to align the first rail 108 and the second rail 110. Additionally, the first support 300 and the second support may function to support the second rail 110. For example, if the first support 300 and the second support are coupled to the wall 102 and the second rail 110 is not coupled to the wall 102, the first support 300 and the second support may support the second rail 110. In another example, the first support 300 and the second support may support the second rail 110 if the first support 300, the second support, and the second rail 110 are not coupled to the wall 102 and the first rail 108 is coupled to the wall 102.

The first shutter 112 includes a first edge, shown as a first edge 304, and a second edge, shown as a second edge 306. The first edge 304 is configured to interface with the first rail 108 to facilitate selective repositioning of the first shutter 112 with respect to the first rail 108. Similarly, the second edge 306 is configured to interface with the second rail 110 to facilitate selective repositioning of the first shutter 112 with respect to the second rail 110. The first edge 304 is parallel to the second edge 306. In various embodiments, the first shutter 112 is rectangular and includes lateral sides perpendicular to both the first edge 304 and the second edge 306.

In an exemplary embodiment, the first edge 304 is generally C-shaped and includes a first portion, shown as a first tongue 308, a second portion, shown as a groove 312, and a second portion, shown as a second tongue 314. The groove 312 is contiguous with both the first tongue 308 and the second tongue 314. In various embodiments, the first tongue 308, the groove 312, and the second tongue 314 extend entirely along the first edge 304 (e.g., from one distal edge of the first edge 304 to another distal edge of the first edge 304, etc.). In some embodiments, the first edge 304 is symmetrical about a plane bisecting the first edge 304 along a length of the first edge 304.

According to an exemplary embodiment, the first rail 108 is generally W-shaped and includes a first portion, shown as a first tongue 316, a second portion, shown as a first groove 318, a third portion, shown as a second tongue 320, a fourth portion, shown as a second groove 322, and a fifth portion, shown as a third tongue 324. The first groove 318 is contiguous with both the first tongue 316 and the second tongue 320. Similarly, the second groove 322 is contiguous with both the second tongue 320 and the third tongue 324. In various embodiments, the first tongue 316, the first groove 318, the second tongue 320, the second groove 322, and the third tongue 324 extend entirely along the an edge of the first rail 108 (e.g., from one distal edge of the first rail 108 to another distal edge of the first rail 108, etc.). In some embodiments, the first rail 108 is symmetrical about a plane bisecting the first rail 108 along a length of the first rail 108.

The first groove 318 and the second groove 322 of the first rail 108 are configured to receive the first tongue 308 and the second tongue 314 of the first edge 304 of the first shutter 112 such that the first tongue 316 and the third tongue 324 contain a portion of the first shutter 112 therebetween. Similarly, the groove 312 of the first edge 304 of the first shutter 112 is configured to receive the second tongue 320 of the first rail 108. Repositioning of the first shutter 112 with respect to the first rail 108 causes the first tongue 316 and the third tongue 324 of the first rail 108 to be linearly translated along the first shutter 112, the first tongue 308 and the second tongue 314 of the first edge 304 to be linearly translated along the first groove 318 and the second groove 322 of the first rail 108, respectively, and causes the second tongue 320 of the first rail 108 to be linearly translated along the groove 312 of the first edge 304.

The groove 312 of the first edge 304 includes a mating feature (not shown) which is configured to selectively interface with a mating feature, shown as a mating feature 326, included on the second tongue 320 of the first rail 108 to resist (e.g., impede, etc.) linear translation of the first shutter 112 relative to the first rail 108. In this way, the first shutter 112 may be held (e.g., positioned, etc.) at a position relative to the first rail 108. Additional mating features like the mating feature 326 may be included on the second tongue 320 of the first rail 108 and additional mating features may be included on the groove 312 of the first edge 304, such that the first shutter 112 may be held at multiple positions relative to the first rail 108. For example, the groove 312 on the first edge 304 may include a first mating feature, which may interface with the mating feature 326 on the second tongue 320 of the first rail 108 to hold the first shutter 112 in a first position (e.g., an open position, etc.), and a second mating feature, which may interface with the mating feature 326 on the second tongue 320 of the first rail 108 to hold the first shutter 112 in a first position (e.g., a closed position, etc.).

In an exemplary embodiment, the second edge 306 is generally C-shaped and includes a first portion, shown as a first tongue 328, a second portion, shown as a groove 330, and a second portion, shown as a second tongue 332. The groove 330 is contiguous with both the first tongue 328 and the second tongue 332. In various embodiments, the first tongue 328, the groove 330, and the second tongue 332 extend entirely along the second edge 306 (e.g., from one distal edge of the second edge 306 to another distal edge of the second edge 306, etc.). In some embodiments, the second edge 306 is symmetrical about a plane bisecting the second edge 306 along a length of the second edge 306.

According to an exemplary embodiment, the second rail 110 is generally W-shaped and includes a first portion, shown as a first tongue 334, a second portion, shown as a first groove 336, a third portion, shown as a second tongue 338, a fourth portion, shown as a second groove 340, and a fifth portion, shown as a third tongue 342. The first groove 336 is contiguous with both the first tongue 334 and the second tongue 338. Similarly, the second groove 340 is contiguous with both the second tongue 338 and the third tongue 342. In various embodiments, the first tongue 334, the first groove 336, the second tongue 338, the second groove 340, and the third tongue 342 extend entirely along the an edge of the second rail 110 (e.g., from one distal edge of the second rail 110 to another distal edge of the second rail 110, etc.). In some embodiments, the second rail 110 is symmetrical about a plane bisecting the second rail 110 along a length of the second rail 110.

The first groove 336 and the second groove 340 of the second rail 110 are configured to receive the first tongue 328 and the second tongue 332 of the second edge 306 of the first shutter 112 such that the first tongue 334 and the third tongue 342 contain a portion of the first shutter 112 therebetween. Similarly, the groove 330 of the second edge 306 of the first shutter 112 is configured to receive the second tongue 338 of the second rail 110. Repositioning of the first shutter 112 with respect to the first rail 108 causes the first tongue 334 and the third tongue 342 of the second rail 110 to be linearly translated along the first shutter 112, the first tongue 328 and the second tongue 332 of the second edge 306 to be linearly translated along the first groove 336 and the second groove 340 of the second rail 110, respectively, and causes the second tongue 338 of the second rail 110 to be linearly translated along the groove 330 of the second edge 306.

The groove 330 of the second edge 306 includes a mating feature, shown as a mating feature 344, which is configured to selectively interface with a mating feature (not shown) included on the second tongue 338 of the second rail 110 to resist (e.g., impede, etc.) linear translation of the first shutter 112 relative to the second rail 110. In this way, the first shutter 112 may be held (e.g., positioned, etc.) at a position relative to the second rail 110. The mating feature on the first edge 304 is identical, or at least substantively similar, to the mating feature 344 on the second edge 306, and the mating feature on the second rail 110 is identical, or at least substantively similar, to the mating feature 326 on the first rail 108. Additional mating features like the mating feature 326 may be included on the second tongue 338 of the second rail 110 and additional mating features like the mating feature 344 may be included on the groove 330 of the second edge 306, such that the first shutter 112 may be held at multiple positions relative to the second rail 110. For example, the groove 330 on the second edge 306 may include a first mating feature 344, which may interface with the mating feature on the second tongue 338 of the second rail 110 to hold the first shutter 112 in a first position (e.g., an open position, etc.), and a second mating feature 344, which may interface with the mating feature on the second tongue 338 of the second rail 110 to hold the first shutter 112 in a first position (e.g., a closed position, etc.).

Figure 10:
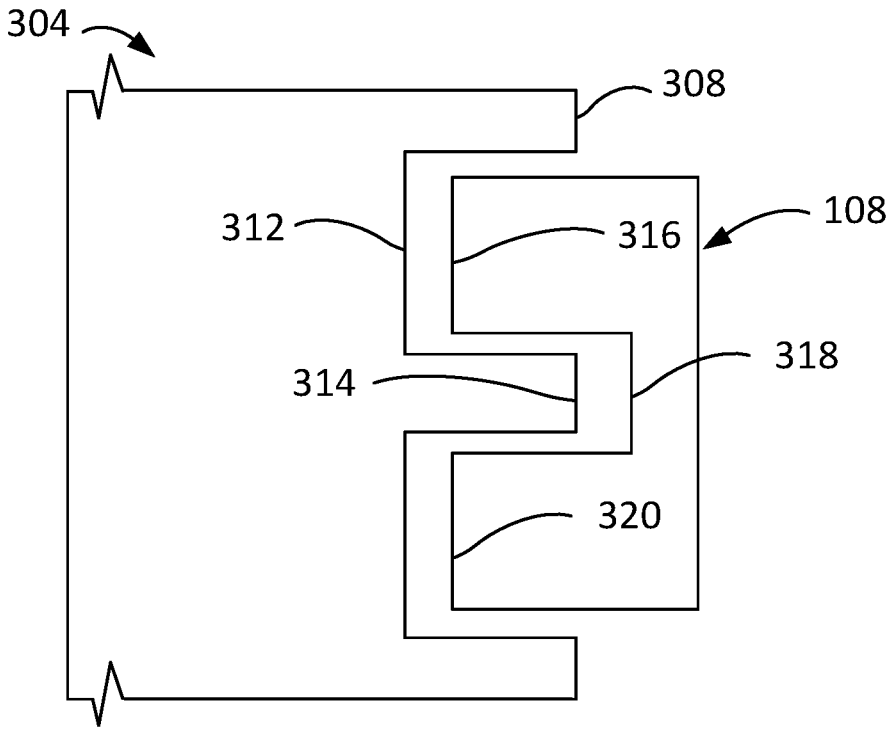
FIG. 10 is detailed end view of a portion of a window shutter system, according to an exemplary embodiment.

In various embodiments, the first edge 304 is identical to the second edge 306 and the first rail 108 is identical to the second rail 110. While the first rail 108, the second rail 110, the first edge 304, and the second edge 306 have been described as including tongues and grooves, it is understood that many similar structural arrangements would facilitate selective repositioning of the first shutter 112 within the first rail 108 and the second rail 110. For example, The first rail 108 may include two tongues and one groove and the first edge 304 may include three tongues and two grooves, for example, as shown in FIG. 10. In another example, the first rail 108 may include only two tongues with one groove therebetween within which the entire first edge 304 is selectively repositioned.

The mating feature 326 is included on both the first rail 108 and the second rail 110, and the mating feature 344 is included on the first edge 304 and the second edge 306. The mating feature 326 may be a protrusion (e.g., tab, bump, post, etc.) and the mating feature 344 may be a recess (e.g., detent, aperture, hole, etc.) configured to selectively receive the mating feature 326. Similarly, the mating feature 326 may be a recess and the mating feature 344 may be a protrusion.

The mating feature 326 may be received within the mating feature 344 as the mating feature 326 is linearly translated towards and then into the mating feature 344. Similarly, the mating feature 326 may be separated from the mating feature 344 as the mating feature 326 is linearly translated out of the mating feature 344. Separation of the mating feature 326 from the mating feature 344 requires a resistance to be overcome. When a force applied to the first shutter 112 is sufficient to overcome the resistance, the mating feature 326 is separated from the mating feature 344 and the first shutter 112 is free to be linearly translated within the first rail 108 and/or the second rail 110. However, when a force applied to the first shutter 112 is not sufficient to overcome the resistance, the mating feature 326 is not separated from the mating feature 344 and the first shutter 112 is not free to be linearly translated within the first rail 108 and/or the second rail 110.

Once the mating feature 326 and the mating feature 344 have been separated, the first shutter 112 may be decoupled from the first rail 108 and/or the second rail 110, thereby allowing the first shutter 112 to be removed from the frame assembly 107 (e.g., for reversing the first shutter 112, for servicing the first shutter 112, for replacement of the first shutter 112, etc.). For example, as the first shutter 112 is slid outwards and the resistance is overcome, the mating feature 344 on the first edge 304 may be removed from the mating feature 326 on the first rail 108 and the mating feature 344 on the second edge 306 may be removed from the mating feature 326 on the second rail 110, allowing the first shutter 112 to be decoupled from the first rail 108 and the second rail 110 upon further outward sliding of the first shutter 112.

The mating features 326 and/or the mating features 344 may include, for example, springs, latches, and/or locks. For example, the mating features 344 may be spring-loaded locks, and the mating features 326 may be latches configured to automatically receive the spring-loaded locks of the mating features 344. In some embodiments, the mating features 326 and/or the mating features 344 are manually engaged and/or disengaged. For example, the mating features 326 may be latches that are selectively repositionable by a user to cause the latches to selectively be coupled to the mating features 344. In various embodiments, the mating features 326 and the mating features 344 can be accessed by a user within the building through the window 104.

In some embodiments, the window shutter system 100 includes, in addition to the mating features 326 and the mating features 344, locks, latches, or retainers that are configured to secure the first shutter 112 within the first rail 108 and/or the second rail 110. In one embodiment, the window shutter system 100 includes various covers or weather stripping to cover the first rail 108, the second rail 110, the first edge 304, and/or the second edge 306. For example, the window shutter system 100 may include a removable cover selectively coupled to the second rail 110 to protect the second rail 110 from the accumulation of, for example, snow and ice.

Figure 6:
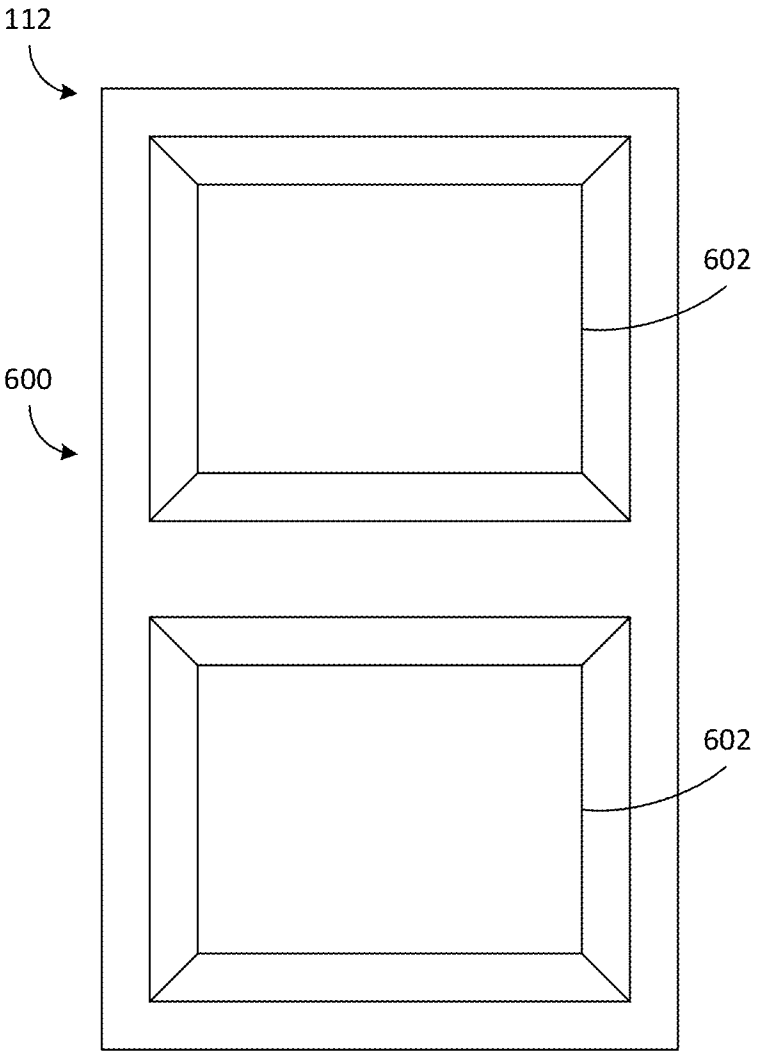
FIG. 6 is a rear view of the shutter shown in FIG. 5.

FIGS. 5 and 6 illustrate the first shutter 112 according to one embodiment. While only the first shutter 112 is shown in FIGS. 5 and 6, it is understood that the description of the first shutter 112 similarly applies to the second shutter 114. The first shutter 112 includes a first side (e.g., front side, etc.), shown as a first side 500. The first side 500 includes a plurality of louvers, shown as louvers 502. The louvers 502 may be variously arranged on the first side 500. For example, the louvers 502 may be uniformly arranged along a length of the first side 500. The louvers 502 may cause the first side 500 to convey a target aesthetic appearance. For example, the first side 500 may convey a traditional or conventional appearance. The first side 500 may be made from a first material, such as wood, vinyl, resin, wood composite, plastic, aluminum, stainless steel, and other similar materials.

According to the embodiment shown in FIG. 6, the first shutter 112 also includes a second side (e.g., front side, etc.), shown as a second side 600. The second side 600 includes a plurality of panels, shown as panels 602. The panels 602 may be variously arranged on the second side 600. For example, the panels 602 may be uniformly arranged along a length of the second side 600. The panels 602 may cause the second side 600 to convey a target aesthetic appearance. For example, the second side 600 may convey an upscale or affluent appearance. In various embodiments, the target aesthetic appearance of the first side 500 is different from the target aesthetic appearance of the second side 600. The second side 600 may be made from a second material, such as wood, vinyl, resin, wood composite, plastic, aluminum, stainless steel, and other similar materials. In some embodiments, the first side 500 is made from a different material than the second side 600. In one embodiment, the first shutter 112 is configured such that the first side 500 is the same as the second side 600. In this way, the first shutter 112 may be reversed when the first side 500 has attained an undesirable aesthetic appearance (e.g., due to degradation, due to accumulation of particulates, etc.), increasing the useful life of the first shutter 112 while maintaining the same target aesthetic appearance.

Figure 8:
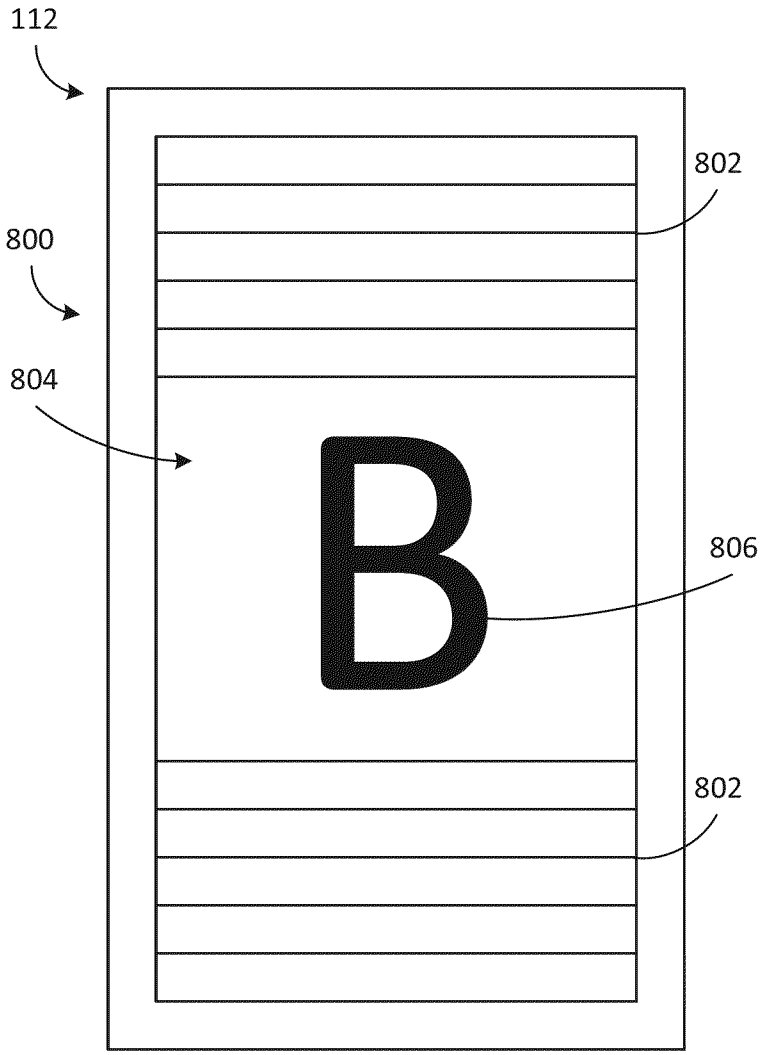
FIG. 8 is a rear view of the shutter shown in FIG. 7.
Figure 7:
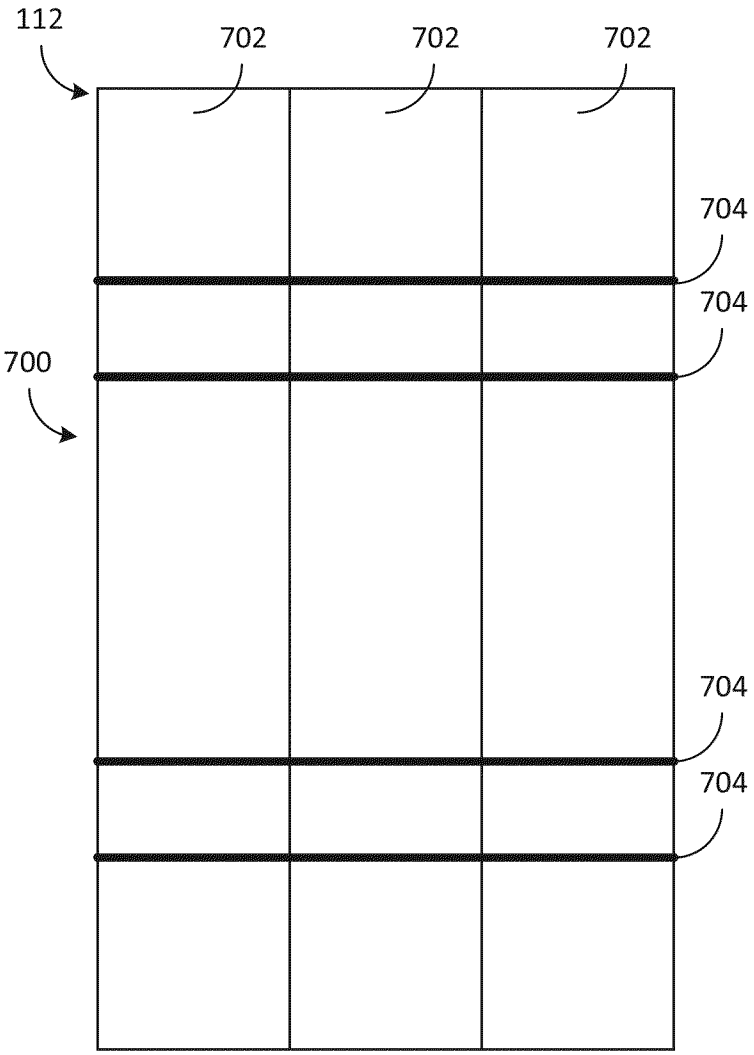
FIG. 7 is a front view of a shutter for the window shutter system shown in FIG. 1.

FIGS. 7 and 8 illustrate the first shutter 112 according to another embodiment. While only the first shutter 112 is shown in FIGS. 7 and 8, it is understood that the description of the first shutter 112 similarly applies to the second shutter 114. The first shutter 112 includes a first side (e.g., front side, etc.), shown as a first side 700. The first side 700 includes a plurality of members, shown as slats 702, and another plurality of members, shown as crossbars 704. The slats 702 and the crossbars 704 may be variously arranged on the first side 700. For example, the slats 702 may be uniformly arranged along a length of the first side 700. The crossbars 704 may extend transversely across all of the slats 702. The slats 702 and the crossbars 704 may cause the first side 700 to convey a target aesthetic appearance. For example, the first side 700 may convey a rustic appearance. The first side 700 may be made from a first material, such as wood, vinyl, resin, wood composite, plastic, aluminum, stainless steel, and other similar materials.

According to the embodiment shown in FIG. 8, the first shutter 112 also includes a second side (e.g., front side, etc.), shown as a second side 800. The second side 800 includes a plurality of louvers, shown as louvers 802. The louvers 802 may be variously arranged on the second side 800. For example, the louvers 802 may be uniformly arranged along a length of the second side 800. The second side 800 is also shown to include a panel, shown as a display panel 804. The display panel 804 may be positioned between groups of louvers 802. The display panel 804 is shown to include a design, shown as a design 806. The design 806 may be, for example, an insignia, a logo, initials, images, a trademark, a name, a date, an alphanumeric string of characters, a sports team's logo, branding, or other similar designs and marks. The louvers 802, the display panel 804, and the design 806 may cause the second side 800 to convey a target aesthetic appearance. For example, the second side 800 may convey an event-specific appearance (e.g., an appearance corresponding to a sports team or event, an appearance corresponding to a date of significance, etc.). In various embodiments, the target aesthetic appearance of the first side 700 is different from the target aesthetic appearance of the second side 800. The second side 800 may be made from a first material, such as wood, vinyl, resin, wood composite, plastic, aluminum, stainless steel, and other similar materials. In some embodiments, the first side 700 is made from a different material than the second side 800. In one embodiment, the first shutter 112 is configured such that the first side 700 is the same as the second side 800. In this way, the first shutter 112 may be reversed when the first side 700 has attained an undesirable aesthetic appearance (e.g., due to degradation, due to accumulation of particulates, etc.), increasing the useful life of the first shutter 112 while maintaining the same target aesthetic appearance.

Figure 9:
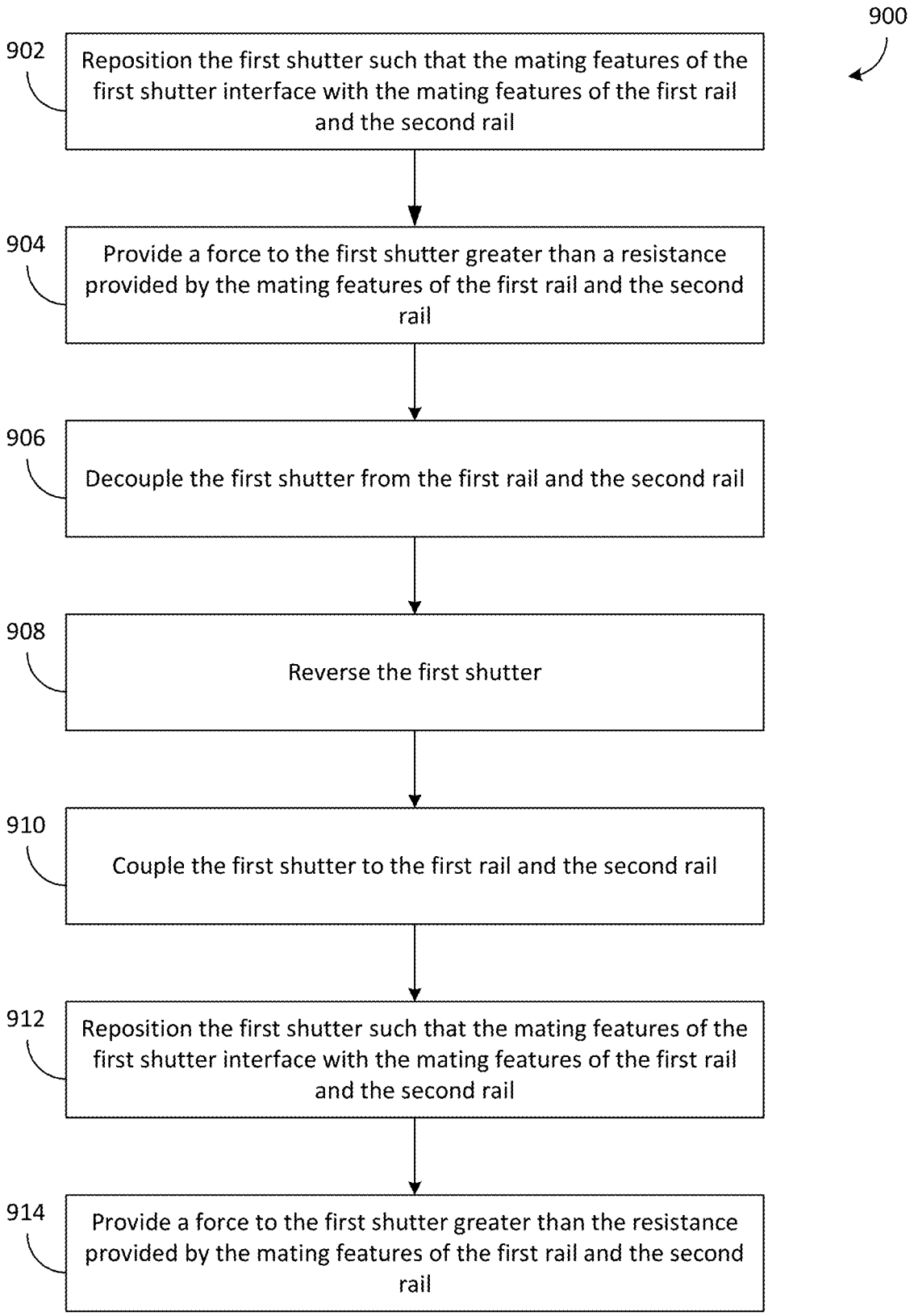
FIG. 9 is a block diagram of a process for reversing a shutter of a window shutter system such as the window shutter system shown in FIG. 1.

FIG. 9 illustrates a process (e.g., method, etc.), shown as a process 900, for reversing the first shutter 112. While only the first shutter 112 is described in FIG. 9, it is understood that the description of the process 900 with respect to the first shutter 112 similarly applies to the second shutter 114.

The process 900 includes, in block 902, repositioning the first shutter 112 such that the mating features 344 of the first shutter 112 interface with the mating features 326 of the first rail 108 and the second rail 110. For example, the first shutter 112 may be slid such that the mating feature 326 of the first rail 108 is received in the mating feature 344 of the first edge 304 and such that the mating feature 326 of the second rail 110 is received in the mating feature 344 of the second edge 306. The process 900 also includes, in block 904, providing a force to the first shutter 112 greater than a resistance provided by the mating features 326 of the first rail 108 and the second rail 110 (e.g., from the interfacing between the mating features 344 of the first shutter 112 and the mating features 326 of the first rail 108 and the second rail 110, etc.). This force may, for example, cause the mating features 344 of the first shutter 112 to be removed from the mating features 326 of the first rail 108 and the second rail 110.

The process 900 also includes, in block 906, decoupling the first shutter 112 from the first rail 108 and the second rail 110. For example, the first shutter 112 may be removed from the first rail 108 and the second rail 110 by pulling the first shutter 112 away from the first rail 108 and the second rail 110. The process 900 also includes, in block 908, reversing the first shutter 112. For example, the first shutter 112 may be reversed such that a second side of the first shutter 112 is displayed, rather than a first side of the first shutter 112 which was displayed before the first shutter 112 was reversed. In this way, a user may change a target aesthetic appearance of the first shutter 112.

The process 900 also includes, in block 910, coupling the first shutter 112 to the first rail 108 and the second rail 110. For example, the first shutter 112 may be inserted into the first rail 108 and the second rail 110 by pushing the first shutter 112 towards the first rail 108 and the second rail 110. The process 900 also includes, in block 912, repositioning the first shutter 112 such that the mating features 344 of the first shutter 112 interface with the mating features 326 of the first rail 108 and the second rail 110. For example, the first shutter 112 may be slid such that the mating feature 326 of the first rail 108 is received in the mating feature 344 of the first edge 304 and such that the mating feature 326 of the second rail 110 is received in the mating feature 344 of the second edge 306. The process 900 also includes, in block 914, providing a force to the first shutter 112 greater than a resistance provided by the mating features 326 of the first rail 108 and the second rail 110 (e.g., from the interfacing between the mating features 344 of the first shutter 112 and the mating features 326 of the first rail 108 and the second rail 110, etc.). This force may, for example, cause the mating features 344 of the first shutter 112 to be removed from the mating features 326 of the first rail 108 and the second rail 110. The process 900 may include other actions such as, for example, causing the first shutter 112 to be positioned such that the mating features 344 of the first shutter 112 interface with other mating features 326 of the first rail 108 and the second rail 110 (e.g., to place the first shutter 112 in a target position relative to the first rail 108 and the second rail 110, etc.). The process 900 may be similarly implemented for servicing, painting, or replacing the first shutter 112. In some embodiments, the process 900 can be completed by a user within a building through the window 104.

It should be noted that references to "front" and "back" in this description are merely used to identify the various elements as they are oriented in the Figures. These terms are not meant to limit the element which they describe, as the various elements may be oriented differently in various temperature controlled cases.

Further, for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It is important to note that the construction and arrangement of the elements of window shutter system 100 provided herein are illustrative only. Although only a few exemplary embodiments of the present inventions have been described in detail in this disclosure, those skilled in the art who review this disclosure will readily appreciate that many modifications are possible in these embodiments (e.g., the structure of the first rail 108 and the second rail 110, the arrangement of the mating features 326 and the mating features 344, etc.) without materially departing from the novel teachings and advantages of the disclosure. Accordingly, all such modifications are intended to be within the scope of the disclosure.

What is claimed:

1. A window shutter system configured to be coupled to a wall, the window shutter system comprising:

a frame assembly comprising:

a first rail, the first rail protruding from the wall when the window shutter system is coupled to the wall and being parallel to the wall when the window shutter system is coupled to the wall, the first rail comprising:

a first mating feature;

a first surface, the first surface in confronting relation with the wall when the window shutter system is coupled to the wall;

a second surface opposite the first surface;

a first tongue;

a first groove contiguous with the first tongue; and a second tongue contiguous with the first groove, the first groove separating the first tongue and the second tongue;

a second rail, the second rail being parallel to the first rail when the window shutter system is coupled to the wall, the second rail comprising:

a third surface, the third surface in confronting relation with the wall when the window shutter system is coupled to the wall; and a fourth surface opposite the third surface; and a first shutter configured to be selectively coupled to the first rail and the second rail, selectively repositionable between a first rail end and a second rail end, and selectively repositionable between a third rail end and a fourth rail end, the first shutter comprising:

a second mating feature configured to selectively interface with the first mating feature to maintain a position of the first shutter relative to the first rail;

a first side configured to be selectively exposed;

a second side configured to be selectively exposed, the second side different from the first side;

a third tongue;

a second groove configured to receive the first tongue, the second groove contiguous with the third tongue;

a fourth tongue configured to be received in the first groove, the fourth tongue contiguous with the second groove;

a third groove configured to receive the second tongue, the third groove contiguous with the fourth tongue; and a fifth tongue contiguous with the third groove, the third groove separating the fifth tongue and the fourth tongue;

wherein the first shutter is reversible such that the first side of the first shutter is exposed when the first shutter is coupled to the first rail and the second rail in a first configuration and the second side of the first shutter is exposed when the first shutter is coupled to the first rail and the second rail in a second configuration.

2. The window shutter system of claim 1, wherein the first side has a first target aesthetic appearance and the second side has a second target aesthetic appearance different from the first target aesthetic appearance.

3. The window shutter system of claim 1, wherein the first side is made, in part, from a first material and the second side is made, in part, from a second material different from the first material, the first material having a first target aesthetic appearance and the second material having a second target aesthetic appearance.

4. The window shutter system of claim 3, further comprising a second shutter configured to be selectively coupled to the first rail and the second rail independent of the first shutter, selectively repositionable between the first rail end and the second rail end independent of the first shutter, and selectively repositionable between the third rail end and the fourth rail end independent of the first shutter.

5. The window shutter system of claim 4, wherein the second rail comprises a third mating feature; and wherein the second shutter comprises:

a fourth mating feature configured to selectively interface with the third mating feature to maintain a position of the second shutter relative to the second rail;

a third side configured to be selectively exposed; and a fourth side configured to be selectively exposed, the fourth side different from the third side.

6. The window shutter system of claim 5, wherein the second shutter is reversible such that the third side of the second shutter is exposed when the second shutter is coupled to the first rail and the second rail in a third configuration and the fourth side of the second shutter is exposed when the second shutter is coupled to the first rail and the second rail in a fourth configuration.

7. The window shutter system of claim 6, wherein the third side has a third target aesthetic appearance and the fourth side has a fourth target aesthetic appearance different from the third target aesthetic appearance.

8. The window shutter system of claim 7, wherein the third target aesthetic appearance is substantially the same as the first target aesthetic appearance and the fourth target aesthetic appearance is substantially the same as the second target aesthetic appearance.

9. The window shutter system of claim 6, wherein the third side is made, in part, from a third material and the fourth side is made, in part, from a fourth material different from the third material, the third material having a third target aesthetic appearance and the fourth material having a fourth target aesthetic appearance different from the third target aesthetic appearance.

10. The window shutter system of claim 9, wherein the third material is substantially the same as the first material and the fourth material is substantially the same as the second material.

11. A window shutter system, configured to be coupled to a wall, the window shutter system comprising:

a frame assembly comprising:

a first rail, the first rail protruding from the wall when the window shutter system is coupled to the wall and being parallel to the wall when the window shutter system is coupled to the wall, the first rail comprising:

a first tongue;

a first groove contiguous with the first tongue;

a second tongue contiguous with the first groove, the first groove separating the first tongue and the second tongue;

a second groove contiguous with the second tongue, the second tongue separating the second groove and the first groove; and a third tongue contiguous with the second groove, the second groove separating the third tongue and the second tongue;

a second rail, the second rail being parallel to the first rail when the window shutter system is coupled to the wall; and a first shutter configured to be selectively coupled to, and selectively repositionable along, the first rail and the second rail, the first shutter comprising:

a fourth tongue configured to be received in the first groove;

a third groove configured to receive the second tongue, the third groove contiguous with the fourth tongue;

a fifth tongue configured to be received in the second groove, the fifth tongue contiguous with the third groove, the third groove separating the fifth tongue and the fourth tongue;

a first side configured to be selectively exposed and having a first target aesthetic appearance; and a second side configured to be selectively exposed and having a second target aesthetic appearance, the second target aesthetic appearance different from the first target aesthetic appearance;

wherein the first shutter is reversible such that either the first side of the first shutter or the second side of the first shutter is exposed when the first shutter is coupled to the first rail and the second rail.

12. The window shutter system of claim 11, wherein the first side is made, in part, from a first material and the second side is made, in part, from a second material different from the first material.

13. The window shutter system of claim 11, further comprising a second shutter configured to be selectively coupled to, and selectively repositionable along, the first rail and the second rail independent of the first shutter.

14. The window shutter system of claim 13, wherein the second shutter comprises:

a third side configured to be selectively exposed and having a third target aesthetic appearance; and a fourth side configured to be selectively exposed and having a fourth target aesthetic appearance, the fourth target aesthetic appearance different from the third target aesthetic appearance;

wherein the second shutter is reversible independent of the first shutter such that either the third side of the second shutter or the fourth side of the second shutter is exposed when the second shutter is coupled to the first rail and the second rail.

* * * * *